US009792861B2

(12) United States Patent
Chang et al.

(10) Patent No.: US 9,792,861 B2
(45) Date of Patent: Oct. 17, 2017

(54) ELECTRO-PHORETIC DISPLAY CAPABLE OF IMPROVING GRAY LEVEL RESOLUTION AND METHOD FOR DRIVING THE SAME

(71) Applicant: E Ink Holdings Inc., Hsinchu (TW)

(72) Inventors: Ming-Jen Chang, Taoyuan County (TW); Jo-Cheng Huang, Taoyuan County (TW); Shao-Wei Su, Taoyuan County (TW); Chun-An Wei, Taoyuan County (TW); Yao-Jen Hsieh, Taoyuan County (TW)

(73) Assignee: E Ink Holdings Inc., Hsinchu (TW)

( * ) Notice: Subject to any disclaimer, the term of this patent is extended or adjusted under 35 U.S.C. 154(b) by 208 days.

(21) Appl. No.: 13/928,371

(22) Filed: Jun. 26, 2013

(65) Prior Publication Data

US 2014/0085355 A1 Mar. 27, 2014

(30) Foreign Application Priority Data

Sep. 26, 2012 (TW) ..... 101135364 A

(51) Int. Cl.
*G09G 3/34* (2006.01)

(52) U.S. Cl.
CPC ..... *G09G 3/344* (2013.01)

(58) Field of Classification Search
CPC ..... G09G 3/344; G09G 3/3446; G09G 2310/068; G02F 1/167
USPC ..... 345/107
See application file for complete search history.

(56) References Cited

U.S. PATENT DOCUMENTS 6,661,402 B1 * 12/2003 Nitta et al. ..... 345/99
2005/0052890 A1 * 3/2005 Morita ..... G09G 3/3688 365/87
2007/0080905 A1 * 4/2007 Takahara ..... G09G 3/3233 345/76

(Continued)

FOREIGN PATENT DOCUMENTS

TW 201033968 9/2010
TW 201203202 1/2012

(Continued)

OTHER PUBLICATIONS

"Office Action of Taiwan Counterpart Application", issued on May 29, 2014, p. 1-p. 11.

*Primary Examiner* — Ram Mistry
(74) *Attorney, Agent, or Firm* — Jianq Chyun IP Office

(57) ABSTRACT

An electro-phoretic display and a method for driving the same are provided, where the electro-phoretic display has a plurality of pixel units. The method includes: setting a plurality of particle tightening time periods and a plurality of gray level displaying time periods for the pixel units respectively, where each of the gray level displaying time periods is arranged after each corresponding particle tightening time period; providing a plurality of particle tightening voltages to the pixel units for tightening the particles of the pixel units respectively during the particle tightening time periods, and providing a plurality of display driving voltages to the pixel units during the gray level displaying time periods. The particle tightening time periods and/or the gray level displaying time periods are determined by a plurality of display gray level data corresponding to the pixel units.

10 Claims, 8 Drawing Sheets

(56) References Cited

U.S. PATENT DOCUMENTS

| | | | | |
|---|---|---|---|---|
| 2007/0205978 | A1* | 9/2007 | Zhou et al. | 345/107 |
| 2011/0169805 | A1* | 7/2011 | Yamazaki | 345/211 |

FOREIGN PATENT DOCUMENTS

| | | |
|---|---|---|
| TW | 201216250 | 4/2012 |
| TW | 200426746 | 12/2014 |

* cited by examiner

ELECTRO-PHORETIC DISPLAY CAPABLE OF IMPROVING GRAY LEVEL RESOLUTION AND METHOD FOR DRIVING THE SAME

CROSS-REFERENCE TO RELATED APPLICATION

This application claims the priority benefit of Taiwan application serial no. 101135364, filed on Sep. 26, 2012. The entirety of the above-mentioned patent application is hereby incorporated by reference herein and made a part of this specification.

BACKGROUND

Technical Field

The invention relates to an electro-phoretic display and a method for driving the same. Particularly, the invention relates to an electro-phoretic display capable of improving a gray level resolution and a method for driving the same.

Related Art

In a conventional electro-phoretic display, when pixel units therein are driven, gray level values to be presented by the pixel units are correspondingly adjusted in collaboration with the number of frame periods thereof. In brief, driving voltages are continually provided to the pixel units through different numbers of the frame periods to control a movement level of particles in the pixel units, so as to adjust the gray level values to be presented by the pixel units.

Referring to FIG. 1, FIG. 1 is a waveform diagram of driving voltages of the conventional electro-phoretic display. By providing different driving signals Gk1 and Gk2, the gray level values G1 and G2 presented by the pixel units are different. The driving signal Gk1 continually provides the driving voltage for three frame periods FP, and the driving voltage Gk2 continually provides the driving voltage for four frame periods FP. One frame period is, for example, 10 milliseconds (ms), if a gray level value between the gray level values G1 and G2 is to be generated, it cannot be implemented in the conventional electro-phoretic display. Under a condition that a moving speed of particles in the pixel unit becomes faster, a difference between the gray level values G1 and G2 generated by the conventional electro-phoretic display becomes greater, so that the pixel units cannot effectively present a fine gray level variation, which decreases a display quality.

SUMMARY

The invention is directed to an electro-phoretic display and a method for driving the same, by which a gray level resolution of the electro-phoretic display is effectively increased.

The invention provides a method for driving an electro-phoretic display, where the electro-phoretic display has a plurality of pixel units. The method for driving the electro-phoretic display includes following steps. A plurality of particle tightening time periods and a plurality of gray level displaying time periods are set for the pixel units respectively, where each of the gray level displaying time periods is arranged after each corresponding particle tightening time period. Moreover, a plurality of particle tightening voltages are respectively provided to the pixel units for increasing a tightening level of particles in the pixel units during the particle tightening time periods, and a plurality of display driving voltages are respectively provided to the pixel units during the gray level displaying time periods, where the particle tightening time periods and/or the gray level displaying time periods are respectively determined by a plurality of display gray level data corresponding to the pixel units.

In an embodiment of the invention, the display driving voltages and/or the particle tightening voltages are respectively determined by the display gray level data corresponding to the pixel units.

In an embodiment of the invention, a time length of each of the particle tightening time periods is equal to an integer multiple of a frame period of the electro-phoretic display.

In an embodiment of the invention, the particle tightening time periods are respectively determined by the display gray level data corresponding to the pixel units, and the gray level displaying time periods are equal to a gray level display predetermined value.

In an embodiment of the invention, the gray level displaying time periods are respectively determined by the display gray level data corresponding to the pixel units, and the particle tightening time periods are equal to a particle tightening predetermined value.

In an embodiment of the invention, in the setting step, a plurality of particle loosing time periods are set for the pixel units respectively, where each of the particle loosing time periods is arranged between each corresponding particle tightening time period and each corresponding gray level displaying time period. Moreover, during the particle loosing time periods, the pixels units present a floating state to decrease the tightening level of the particles in the pixel units, where the particle tightening time periods, the particle loosing time periods and/or the gray level displaying time periods are respectively determined by a plurality of display gray level data corresponding to the pixel units.

The invention provides an electro-phoretic display including a display panel and a driver. The display panel has a plurality of pixel units. The driver is coupled to the display panel. The driver respectively sets a plurality of particle tightening time periods and a plurality of gray level displaying time periods for the pixel units, where each of the gray level displaying time periods is arranged after each corresponding particle tightening time period. The driver respectively provides a plurality of particle tightening voltages to the pixel units for increasing a tightening level of particles in the pixel units during the particle tightening time periods. The driver respectively provides a plurality of display driving voltages to the pixel units during the gray level displaying time periods, where the driver respectively determines the particle tightening time periods and/or the gray level displaying time periods according to a plurality of display gray level data corresponding to the pixel units.

According to the above descriptions, by increasing the tightening level of the particles in the pixel units of the electro-phoretic display during the particle tightening time periods before the gray level displaying time periods, during the gray level displaying time periods, the gray level values displayed by the pixel units not only relate to the driving voltages received by the pixel units during the gray level displaying time periods, but also relate to the tightening levels of the particles in the pixel units during the particle tightening time periods. Namely, the gray level values of the pixel units can be effectively increased, and the gray level resolution of the electro-phoretic display is correspondingly increased.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
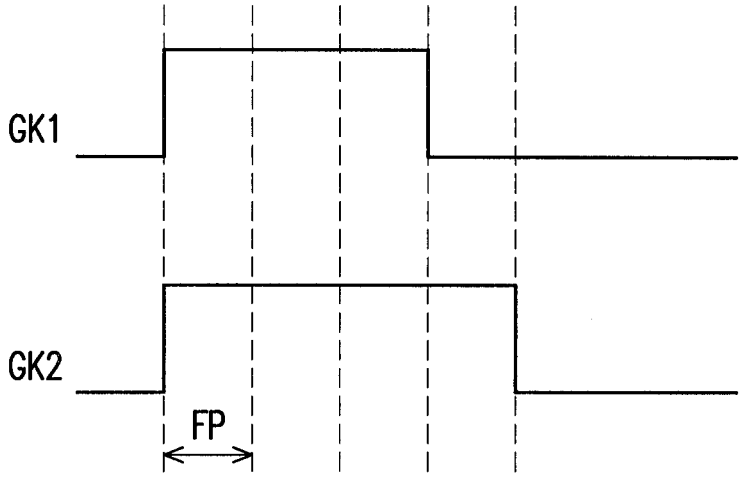
FIG. 1 is a waveform diagram of driving voltages of a conventional electro-phoretic display.
Figure 2:
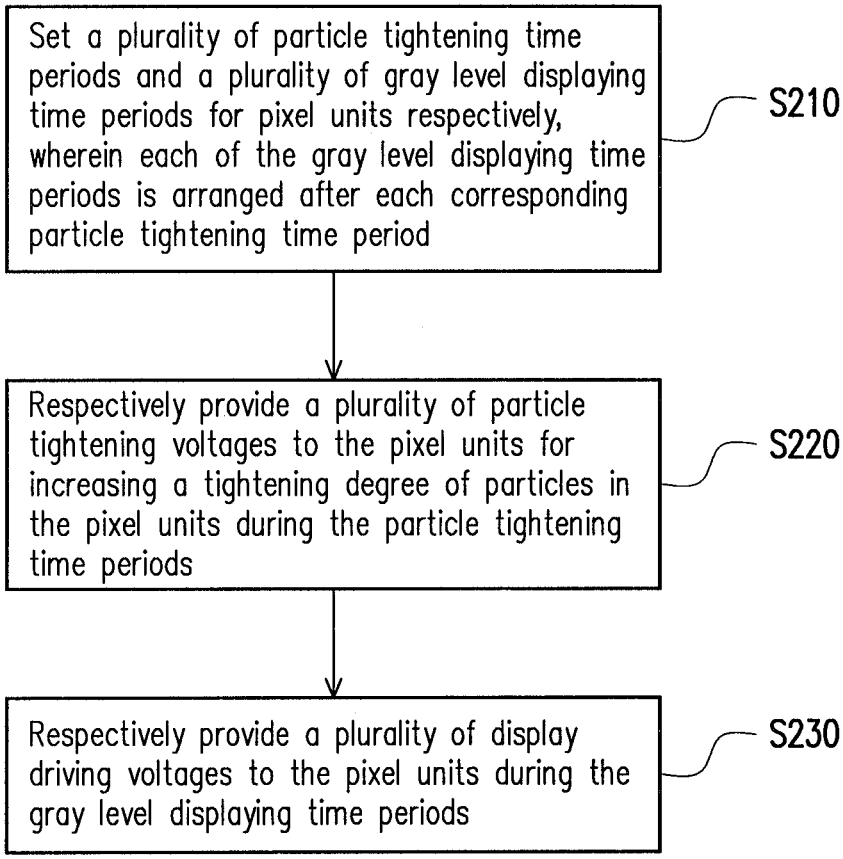
FIG. 2 is a flowchart illustrating a method for driving an electro-phoretic display according to an embodiment of the invention.

Referring to FIG. 2, FIG. 2 is a flowchart illustrating a method for driving an electro-phoretic display according to an embodiment of the invention. The electro-phoretic display has a plurality of pixel units, and the method for driving the electro-phoretic display includes following steps. In step S210, a plurality of particle tightening time periods and a plurality of gray level displaying time periods are set for the pixel units respectively, where each of the gray level displaying time periods is arranged after each corresponding particle tightening time period. Namely, when the pixel units are driven, the pixel units are repeatedly driven according to a sequence of the particle tightening time period and the gray level displaying time period in alternation. By the way, a time length of the particle tightening time period of each pixel unit can be independently set, and a time length of the gray level displaying time period of each pixel unit can also be independently set.

In step S220, when the pixel units are in the particle tightening time periods, a plurality of particle tightening voltages are respectively provided to the corresponding pixel units for increasing a tightening level of particles in the pixel units. Then, in step S230, when the pixel units are in the gray level displaying time periods, a plurality of display driving voltages are respectively provided to the corresponding pixel units to drive the pixel units to display images, where at least one of the particle tightening time period and the gray level displaying time period is determined by display gray level data corresponding to the pixel units.

It should be noticed that when the pixel units are in the particle tightening time periods, the particle tightening voltages are provided to the pixel units, and the particles in the pixel units are arranged in a tightening state. In this way, when the pixel units are in the gray level displaying time periods and are driven by the display driving voltages, a movement level of the particles having the tightening state is different to that of the particles that are not applied with the particle tightening voltages in advance. Namely, due to the function of the particle tightening time periods, the gray level values presented by the pixel units during the gray level displaying time periods can be finely tuned.

Figure 3:
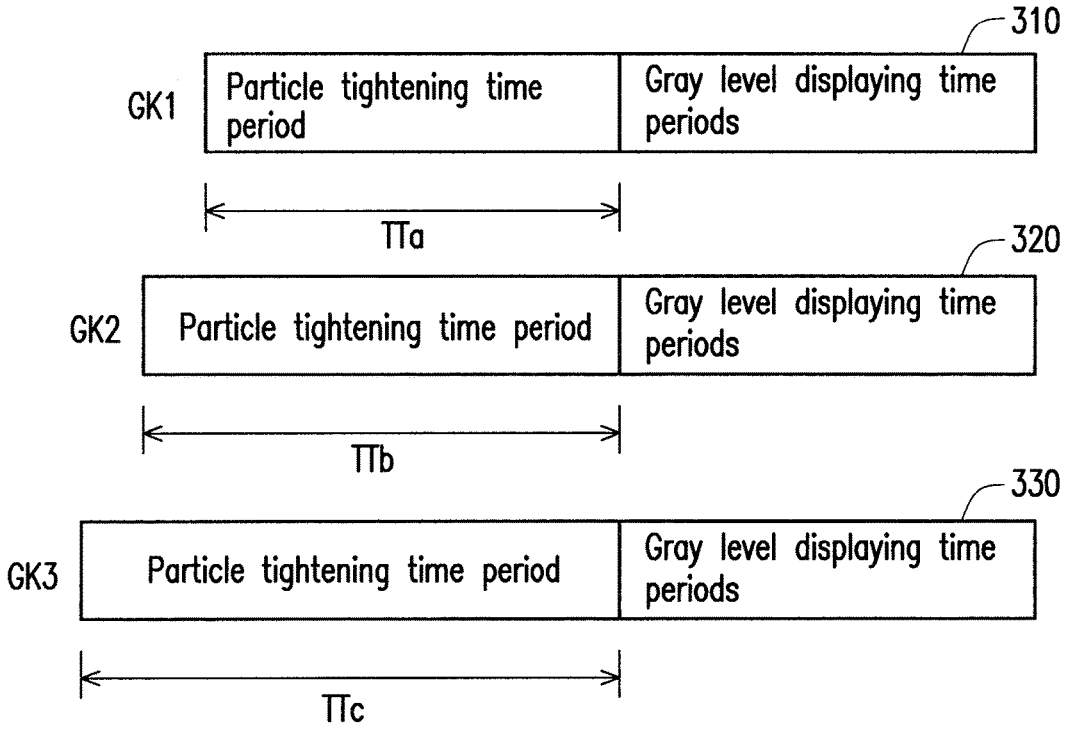
FIG. 3 is a driving waveform diagram of a method for driving an electro-phoretic display according to an embodiment of the invention.

Referring to FIG. 3, FIG. 3 is a driving waveform diagram of the method for driving the electro-phoretic display according to an embodiment of the invention. When the pixel units receive different driving signals Gk1-Gk3, the gray level values presented by the pixel units can be adjusted. A time length TTb of the particle tightening time period 320 of the driving signal Gk2 is greater than a time length TTa of the particle tightening time period 310 of the driving signal Gk1, and a time length TTc of the particle tightening time period 330 of the driving signal Gk3 is greater than the time length TTb of the particle tightening time period 320 of the driving signal Gk2. Namely, the gray level values of the pixel units can be adjusted by adjusting the time lengths of the particle tightening time periods of the driving signals received by the pixel units.

Certainly, the gray level values of the pixel units can also be adjusted by adjusting the time lengths of the gray level displaying time periods of the driving signals received by the pixel units. Alternatively, the gray level values of the pixel units can be adjusted by simultaneously adjusting the time lengths of the gray level displaying time periods and the time lengths of the particle tightening time periods of the driving signals received by the pixel units.

Figure 4A:
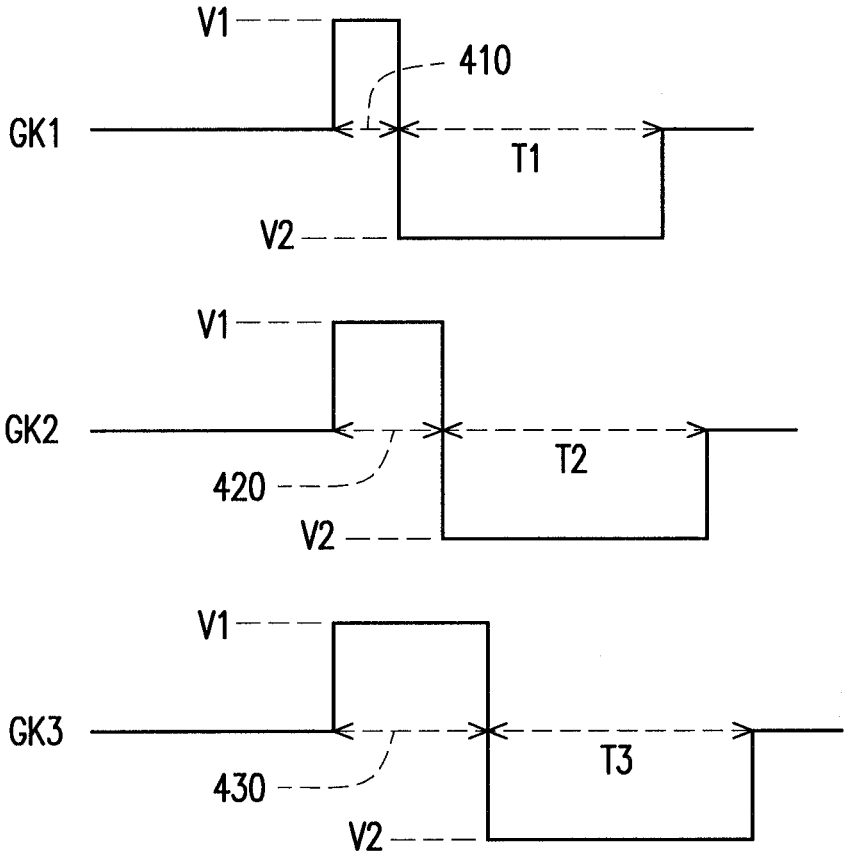
FIG. 4A and FIG. 4B are respectively waveform diagrams of a method for driving an electro-phoretic display according to embodiments of the invention.
Figure 4B:
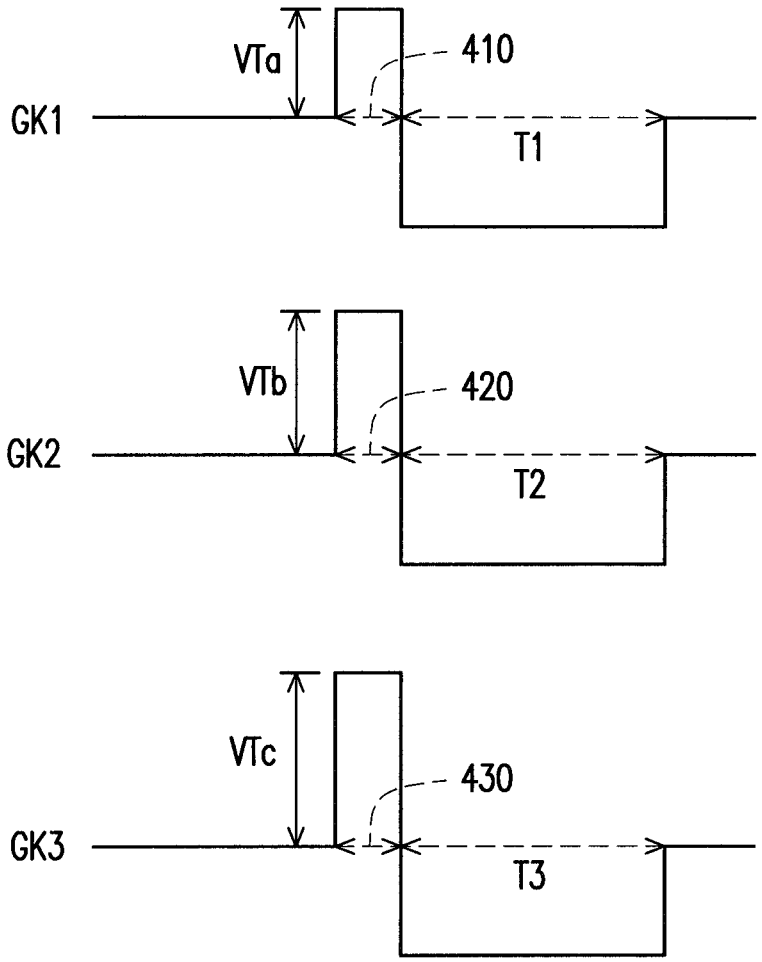

Referring to FIG. 4A and FIG. 4B, FIG. 4A and FIG. 4B are respectively waveform diagrams of the method for driving the electro-phoretic display according to embodiments of the invention. By receiving different driving signals Gk1-Gk3 through the pixel units, the gray level values presented by the pixel units can be adjusted. In FIG. 4A, the driving signal Gk1 provides a particle tightening voltage V1 during a particle tightening time period 410, and the driving signal Gk1 provides a display driving voltage V2 during a gray level displaying time period T1. The driving signal Gk2 provides the particle tightening voltage V1 during a particle tightening time period 420, and the driving signal Gk2 provides the display driving voltage V2 during a gray level displaying time period T2. The driving signal Gk3 provides the particle tightening voltage V1 during a particle tightening time period 430, and the driving signal Gk3 provides the display driving voltage V2 during a gray level displaying time period T3.

In the present embodiment, a time length of the particle tightening time period 410 is smaller than a time length of the particle tightening time period 420, and the time length of the particle tightening time period 420 is smaller than a time length of the particle tightening time period 430. By receiving the particle tightening time periods with different time lengths through the pixel units, the gray level values of the pixel units can be adjusted. Alternatively, by changing the time lengths of the gray level displaying time periods T1-T3 of the driving signals Gk1-Gk3, the gray level values of the pixel units can also be adjusted.

Moreover, in FIG. 4B, the driving signal Gk1 provides a particle tightening voltage VTa during the particle tightening time period 410, the driving signal Gk2 provides a particle tightening voltage VTb during the particle tightening time period 420, and the driving signal Gk3 provides a particle tightening voltage VTc during the particle tightening time period 430. Namely, by receiving different particle tightening voltages through the pixel units during the particle tightening time periods, the gray level values presented by the pixel units can also be adjusted. In the present embodiment, the particle tightening voltage VTa is smaller than the particle tightening voltage VTb, and the particle tightening voltage VTb is smaller than the particle tightening voltage VTc.

By the way, the embodiments of FIG. 4A and FIG. 4B can be combined for application, namely, the time lengths of the particle tightening time periods and the particle tightening voltages in the driving signals can be simultaneously adjusted to finely adjust the gray level values presented by the pixel units.

Moreover, the waveform of the driving signal of the present embodiment is continually and periodically repeated along with a driving state of the pixel unit, and FIG. 4A and FIG. 4B are only schematic diagrams, which are not used to limit the invention.

In the aforementioned embodiments and implementations, the time length of the particle tightening time period and the time length of the gray level displaying time period can be set according to the display gray level data corresponding to the pixel units. Similarly, the particle tightening voltages and the display driving voltages can also be set according to the display gray level data corresponding to the pixel units. The gray level displaying time period can be set to a gray level display predetermined value, and the particle tightening time period can be set to a particle tightening predetermined value. Moreover, the time length of each of the particle tightening time periods is equal to an integer multiple of a frame period of the electro-phoretic display.

Figure 5A:
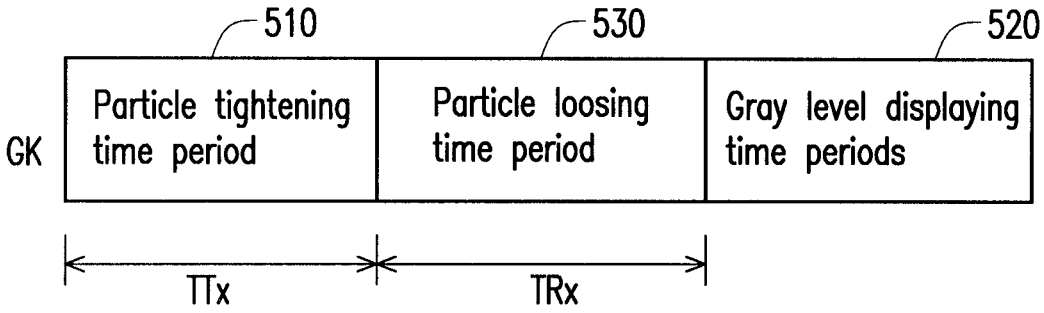
FIG. 5A is a schematic diagram of a driving signal according to another embodiment of the invention.

Referring to FIG. 5A, FIG. 5A is a schematic diagram of a driving signal according to another embodiment of the invention. In the present embodiment, in the driving signal Gk, a particle loosing time period 530 is further set between a particle tightening time period 510 and a gray level displaying time period 520. In the present embodiment, the particle tightening time period 510 has a time length TTx, and the particle loosing time period 530 has a time length TRx. During the particle loosing time periods 530 of the driving signal Gk, the pixels units present a floating state to decrease the tightening level of the particles in the pixel units.

By setting the particle loosing time periods 530, the particles tightened during the particle tightening time periods 510 can be suitably loosed, and a loosing level thereof can also be used to change the gray level values presented by the pixel units during the gray level displaying time periods 520.

According to the above descriptions, it is known that in order to adjust the gray level values presented by the display units, the time length TTx of the particle tightening time period 510 can be adjusted, or the time length TRx of the particle loosing time period 530 can be adjusted, and certainly, the time length TTx of the particle tightening time period 510 and the time length TRx of the particle loosing time period 530 can be simultaneously adjusted.

Figure 5B:
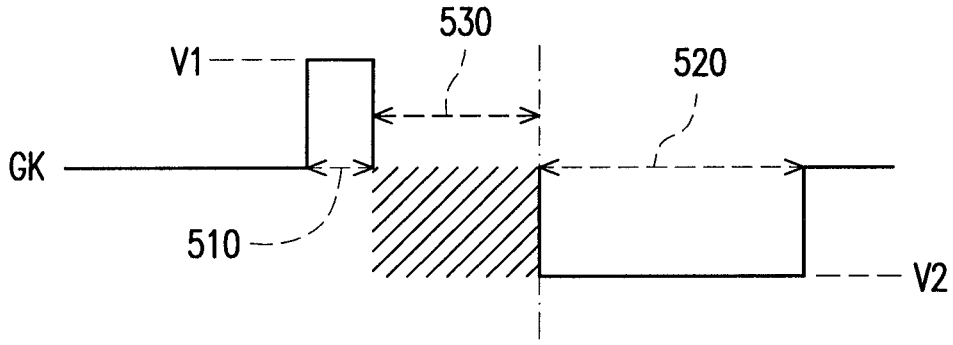
FIG. 5B is a waveform diagram of a driving signal according to an embodiment of the invention.

Referring to FIG. 5B, FIG. 5B is a waveform diagram of a driving signal according to an embodiment of the invention. The driving signal Gk provides the particle tightening voltage V1 to the pixel unit during the particle tightening time period 510, and makes the pixel unit to present a floating state during the particle loosing time period 530. Moreover, the driving signal Gk provides the display driving voltage V2 to the pixel unit to drive the pixel unit to display image during the gray level displaying time period 520.

Figure 6A:
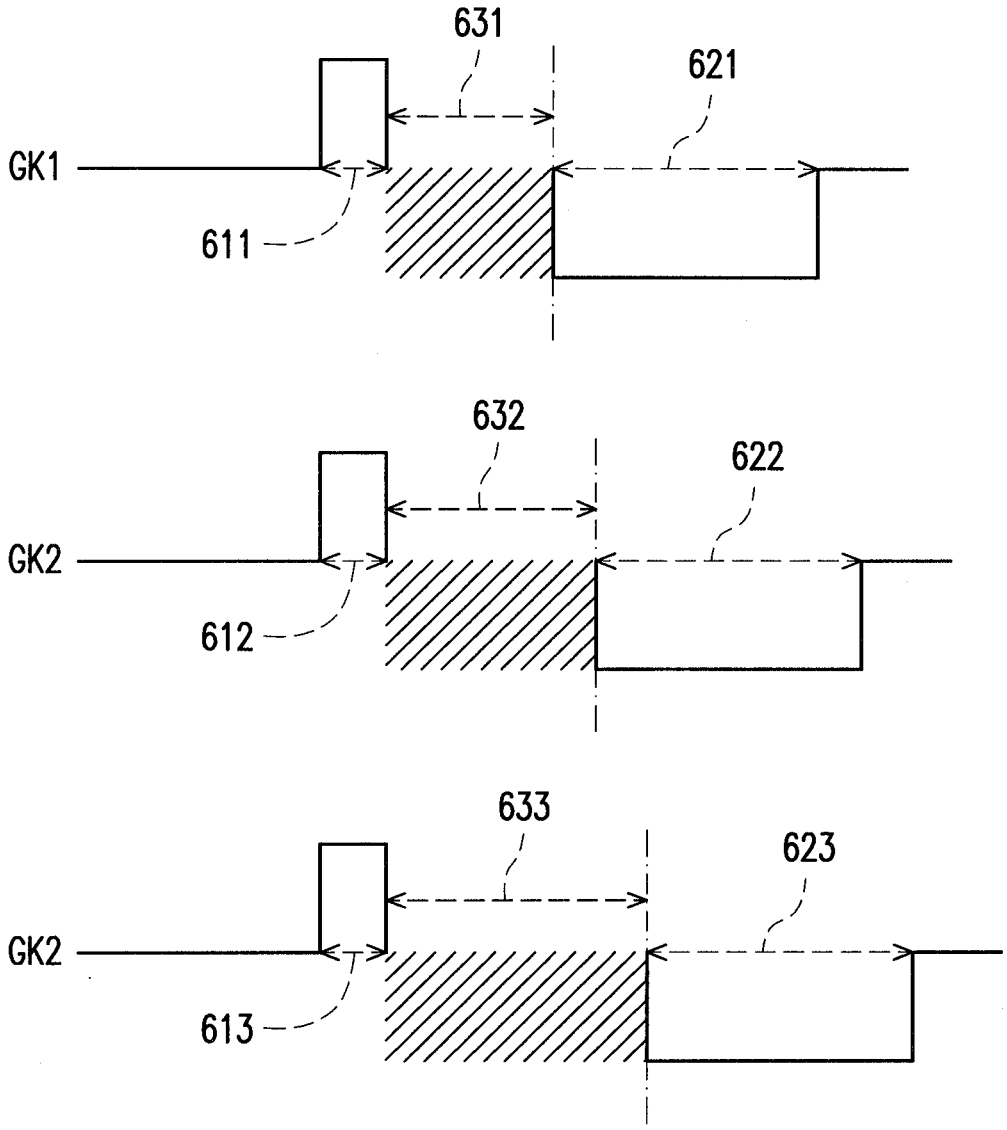
FIG. 6A and FIG. 6B are respectively waveform diagrams of driving signals according to an embodiment of the invention.
Figure 6B:
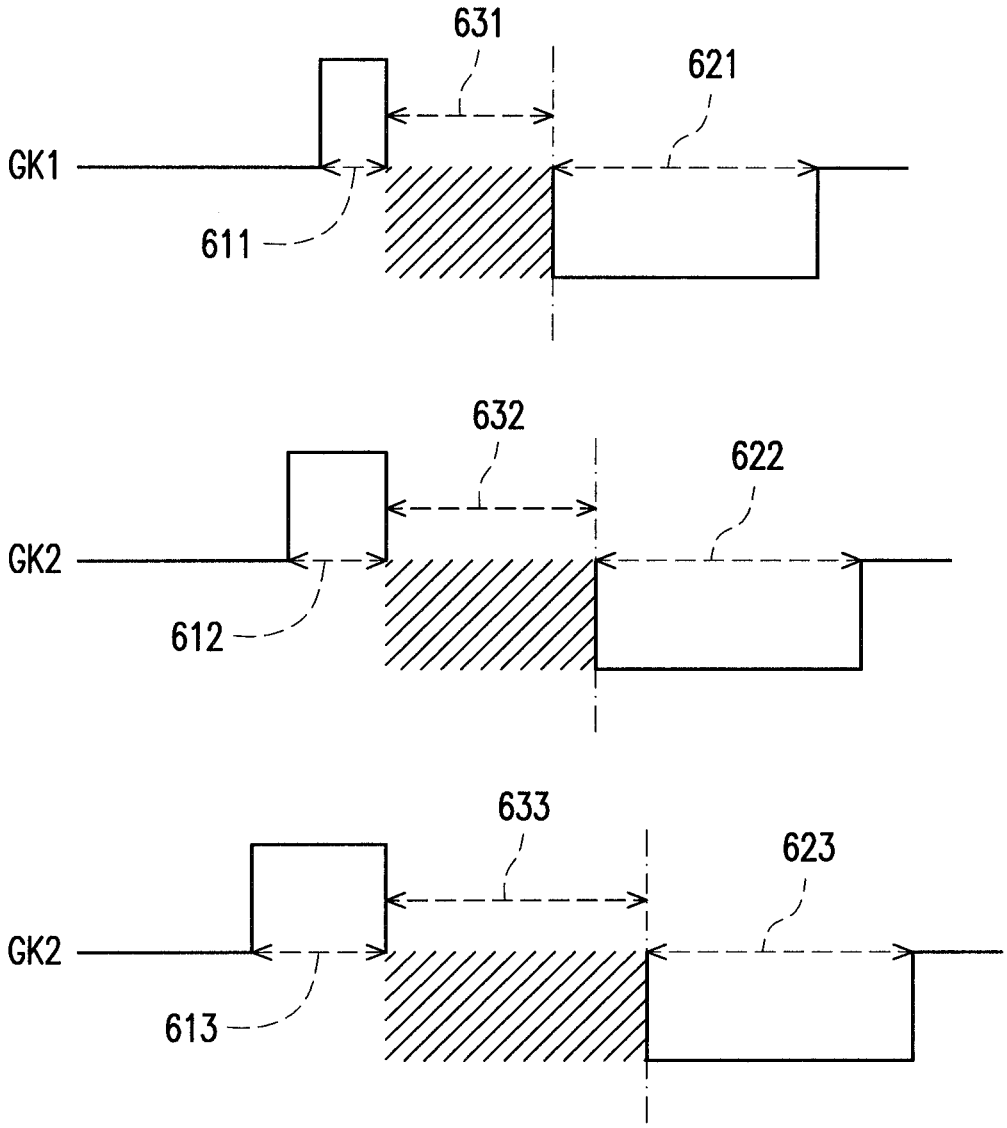

Referring to FIG. 6A and FIG. 6B, FIG. 6A and FIG. 6B are respectively waveform diagrams of driving signals according to an embodiment of the invention. The driving signal Gk1 is set to have a particle tightening time period 611, a particle loosing time period 631 and a gray level displaying time period 621. In FIG. 6A, the gray level values presented by the pixel units can be adjusted through the driving signals Gk1-Gk3 having the particle loosing time periods 631-633 of different time lengths. In FIG. 6B, the gray level values presented by the pixel units can also be adjusted through the driving signals Gk1-Gk3 having the particle loosing time periods 631-633 of different time lengths and the particle tightening time periods 611-613 of different time lengths. Certainly, by adjusting the gray level displaying time periods of the driving signals, the corresponding pixel unit can also be adjusted.

Here, the time lengths of the particle loosing time periods 631-633 can be set according to the display gray level data corresponding to the pixel units, and the particle loosing time periods 631-633 can be integer multiples of the frame period of the electro-phoretic display.

Figure 7:
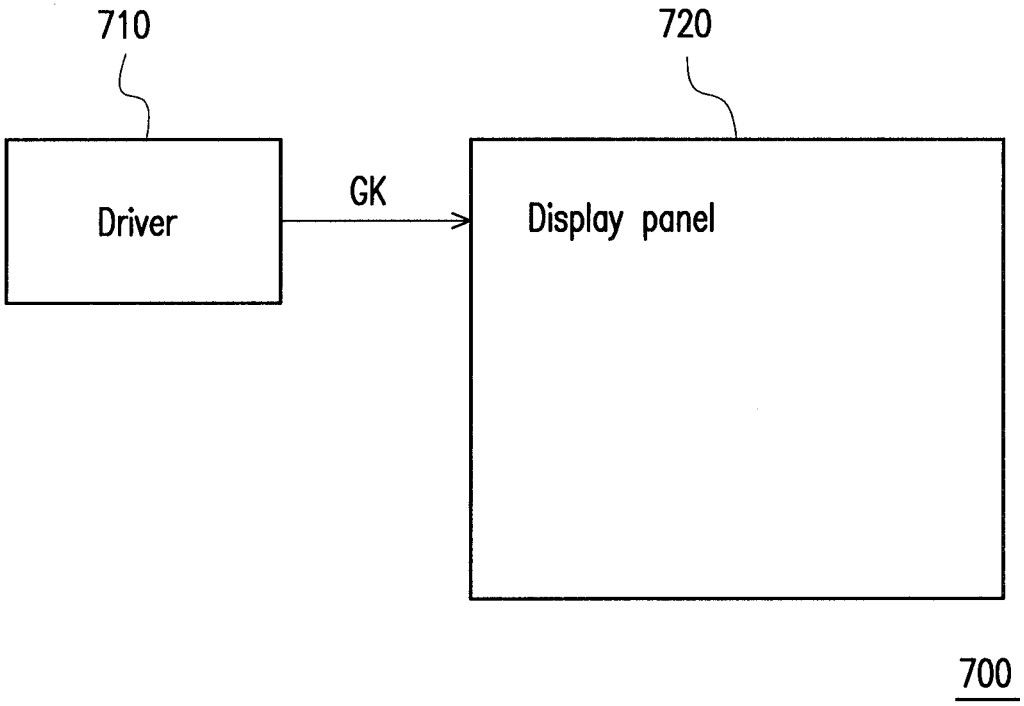
FIG. 7 is a schematic diagram of an electro-phoretic display according to an embodiment of the invention.

Referring to FIG. 7, FIG. 7 is a schematic diagram of an electro-phoretic display according to an embodiment of the invention. The electro-phoretic display 700 includes a driver 710 and a display panel 720. The display panel 720 is an electro-phoretic display panel and has a plurality of pixel units. The driver 710 is coupled to the display panel 720. The driver 710 respectively sets a plurality of particle tightening time periods and a plurality of gray level displaying time periods for the pixel units respectively, where each of the gray level displaying time periods is arranged after each corresponding particle tightening time period. The driver 710 respectively provides a plurality of particle tightening voltages to the pixel units for increasing a tightening level of particles in the pixel units during the particle tightening time periods. The driver 710 respectively provides a plurality of display driving voltages to the pixel units during the gray level displaying time periods, where the driver 710 respectively determines the particle tightening time periods and/or the gray level displaying time periods according to a plurality of display gray level data corresponding to the pixel units.

Details that the electro-phoretic display 700 adjusts the gray level values of the pixel units have been described in the aforementioned embodiments, which are not repeated.

In summary, by providing the particle tightening time periods before the gray level displaying time periods in the driving signals, the tightening level of the particles are changed through the particle tightening voltages, so as to finely adjust the gray level values presented by the pixel units during the gray level displaying time periods. In this way, the pixel units of the electro-phoretic display can precisely present the gray level values of the image to be displayed, so as to effectively improve the display quality of the electro-phoretic display.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A method for driving an electro-phoretic display, wherein the electro-phoretic display has a plurality of pixel units and a plurality of driving lines, the method for driving the electro-phoretic display comprising:

setting a plurality of particle tightening time periods and a plurality of gray level displaying time periods for the pixel units respectively, wherein each of the gray level displaying time periods is arranged after each corresponding particle tightening time period;

respectively providing a plurality of particle tightening voltages to the pixel units for increasing a tightening level of particles in the pixel units during the particle tightening time periods; and respectively providing a plurality of display driving voltages to the pixel units for displaying during the gray level displaying time periods, wherein the particle tightening time periods and/or the gray level displaying time periods are respectively determined by a plurality of display gray level data corresponding to the pixel units, wherein a time length of each of the particle tightening time periods is varied whenever a corresponding one of the plurality of display gray level data corresponding to a corresponding one of the pixel units before displaying is changed, wherein each of the particle tightening voltages of a driving signal and the corresponding display driving voltage of the driving signal are reversed in polarity, and the particle tightening voltage of the driving signal and the corresponding display driving voltage of the driving signal are both sent down the same driving line, wherein the time length of each of the particle tightening time periods is equal to an integer multiple of a frame period of the electro-phoretic display.

2. The method for driving the electro-phoretic display as claimed in claim 1, wherein the display driving voltages and/or the particle tightening voltages are respectively determined by the display gray level data corresponding to the pixel units.

3. The method for driving the electro-phoretic display as claimed in claim 1, wherein the particle tightening time periods are respectively determined by the display gray level data corresponding to the pixel units, and the gray level displaying time periods are equal to a gray level display predetermined value.

4. The method for driving the electro-phoretic display as claimed in claim 1, wherein the gray level displaying time periods are respectively determined by the display gray level data corresponding to the pixel units, and the particle tightening time periods are equal to a particle tightening predetermined value.

5. The method for driving the electro-phoretic display as claimed in claim 1, further comprising:

in the setting step, setting a plurality of particle loosing time periods for the pixel units respectively, wherein each of the particle loosing time periods is arranged between each corresponding particle tightening time period and each corresponding gray level displaying time period; and making the pixel units to present a floating state to decrease the tightening level of the particles in the pixel units during the particle loosing time periods, wherein the particle tightening time periods, the particle loosing time periods and/or the gray level displaying time periods are respectively determined by the plurality of display gray level data corresponding to the pixel units.

6. An electro-phoretic display, comprising:

a display panel, having a plurality of pixel units and a plurality of driving lines; and a driver, coupled to the display panel, the driver respectively setting a plurality of particle tightening time periods and a plurality of gray level displaying time periods for the pixel units, wherein each of the gray level displaying time periods is arranged after each corresponding particle tightening time period, the driver respectively provides a plurality of particle tightening voltages to the pixel units for increasing a tightening level of particles in the pixel units during the particle tightening time periods, and the driver respectively provides a plurality of display driving voltages to the pixel units for displaying during the gray level displaying time periods, wherein the driver respectively determines the particle tightening time periods and/or the gray level displaying time periods according to a plurality of display gray level data corresponding to the pixel units, wherein a time length of each of the particle tightening time periods is varied by the driver whenever a corresponding one of the plurality of display gray level data corresponding to a corresponding one of the pixel units before displaying is changed, wherein each of the particle tightening voltages of a driving signal and the corresponding display driving voltage of the driving signal are reversed in polarity, and the particle tightening voltage of the driving signal and the corresponding display driving voltage of the driving signal are both sent down the same driving line, wherein the time length of each of the particle tightening time periods is equal to an integer multiple of a frame period of the electro-phoretic display.

7. The electro-phoretic display as claimed in claim 6, wherein the driver respectively detennines the display driving voltages and/or the particle tightening voltages according to the display gray level data corresponding to the pixel units.

8. The electro-phoretic display as claimed in claim 6, wherein the driver respectively determines the gray level displaying time periods according to the display gray level data corresponding to the pixel units, and the driver sets the particle tightening time periods to be equal to a particle tightening predetermined value.

9. The electro-phoretic display as claimed in claim 6, wherein the driver respectively determines the particle tightening time periods according to the display gray level data corresponding to the pixel units, and the driver sets the gray level displaying time periods to be equal to a gray level display predetermined value.

10. The electro-phoretic display as claimed in claim 6, wherein the driver further sets a plurality of particle loosing time periods for the pixel units respectively, wherein each of the particle loosing time periods is arranged between each corresponding particle tightening time period and each conesponding gray level displaying time period, the driver makes the pixel units to present a floating state to decrease the tightening level of the particles in the pixel units during the particle loosing time periods, and the driver respectively determines the particle tightening time periods, the particle loosing time periods and/or the gray level displaying time periods according to the plurality of display gray level data corresponding to the pixel units.

* * * * *